US005263777A

United States Patent [19]

Domke

[11] Patent Number: 5,263,777

[45] Date of Patent: Nov. 23, 1993

[54] OVERPRESSURE VALVE FOR PACKAGING CONTAINERS

[75] Inventor: Klaus Domke, Ditzingen, Fed. Rep. of Germany

[73] Assignee: Robert Bosch GmbH, Stuttgart, Fed. Rep. of Germany

[21] Appl. No.: 819,735

[22] Filed: Jan. 13, 1992

[30] Foreign Application Priority Data

Feb. 16, 1991 [DE] Fed. Rep. of Germany ..... 4104803
Sep. 7, 1991 [DE] Fed. Rep. of Germany ..... 4129838

[51] Int. Cl.[5] ..... B65D 33/01
[52] U.S. Cl. ..... 383/103; 426/118
[58] Field of Search ..... 383/100, 102, 103; 426/118; 229/DIG.14

[56] References Cited

U.S. PATENT DOCUMENTS

| | | | |
|---|---|---|---|
| 2,821,338 | 1/1958 | Metzger | 383/103 X |
| 2,927,722 | 3/1960 | Metzger | 383/103 X |
| 2,946,502 | 7/1960 | Metzger | 383/103 X |
| 3,468,471 | 9/1969 | Linder | 383/102 X |
| 3,716,180 | 2/1973 | Bemiss et al. | 426/118 X |
| 4,134,535 | 1/1979 | Barthels et al. | 383/103 X |
| 4,206,870 | 6/1980 | DeVries | 383/103 |
| 4,553,693 | 11/1985 | Terajima et al. | 229/DIG. 14 X |
| 4,653,661 | 3/1987 | Buchner et al. . | |
| 4,715,494 | 12/1987 | Heitzenröder et al. | 383/103 X |

FOREIGN PATENT DOCUMENTS

| | | | |
|---|---|---|---|
| 0023703 | 2/1981 | European Pat. Off. . | |
| 0024310 | 3/1981 | European Pat. Off. . | |
| 3031208 | 4/1982 | Fed. Rep. of Germany | 383/103 |
| 2353451 | 12/1977 | France . | |
| 2387399 | 11/1978 | France . | |
| 279073 | 11/1989 | Japan | 383/103 |

*Primary Examiner*—Allan N. Shoap
*Assistant Examiner*—Jes. F. Pascua
*Attorney, Agent, or Firm*—Edwin E. Greigg; Ronald E. Greigg

[57] ABSTRACT

An overpressure valve for a packaging container, which prevents air from the atmosphere from getting into the package and, in the case of gas-emitting material being packaged, reduces a resultant overpressure by venting gas. The overpressure includes a valve membrane stuck to a wall of the container on top of through holes. The membrane is secured to the wall with peripheral adhesive strips, leaving an adhesive-free zone above the through holes; the adhesive-free zone forms a valve member, and the congruent part of the wall forms a valve seat. The adhesive strips have a wedge shape, so that the transitional regions of the adhesive-free zone toward the adhesive strips, rest on the wall, and the raised peripheral regions form spacers for adjacent packages to permit operation of the overpressure valve while stacked one on the other.

18 Claims, 2 Drawing Sheets

OVERPRESSURE VALVE FOR PACKAGING CONTAINERS

BACKGROUND OF THE INVENTION

The invention is based on an overpressure valve for packaging containers as defined hereinafter. In a valve of this type, known for instance from German Offenlegungsschrift 35 26 586; U.S. Pat. No. 4,653,661, the strips of adhesive, which are disposed in the region of the peripheral zones of the membrane and define the adhesive-free zone, have a rectangular cross section, with a thickness corresponding approximately to that of the membrane. As a result, when the valve is closed, or in other words when the adhesive-free zone of the membrane rests sealingly on the congruent part of the package wall, small channels are formed in the regions of transition between the adhesive-free zone and the peripheral zones having the adhesive strips. Through these channels and the hole in the package wall, air can get into the package from outside, particularly when there is a vacuum in the package, and the oxygen content of this air causes the oxygen-sensitive material in the package to spoil. A valve embodiment in which such leaks cannot occur is thus desirable.

OBJECT AND SUMMARY OF THE INVENTION

The overpressure valve according to the invention has the advantage that when the valve is closed, the elastic valve membrane rests sealingly on the congruent part of the package wall with its adhesive-free zone and with its transitional regions towards the adhesive strips. The thick peripheral part of the adhesive strips also has the effect that one wall of an adjacent package in a collective package is supported on the raised peripheral zones of the membrane, which act as spacers, so that if overpressure occurs in the package, the adhesive-free center zone can bulge freely outward, forming a channel, thus making the overpressure valve functional. These advantages are still more pronounced if the adhesive strips have regions of slight inclination.

A check as to whether an overpressure valve is disposed on a package container can easily be made with electromagnetic or optical scanners, if the adhesive strips are equipped with magnetic or optically detectable particles embedded in the adhesive. A method for simple production of the overpressure valve is defined hereinafter.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
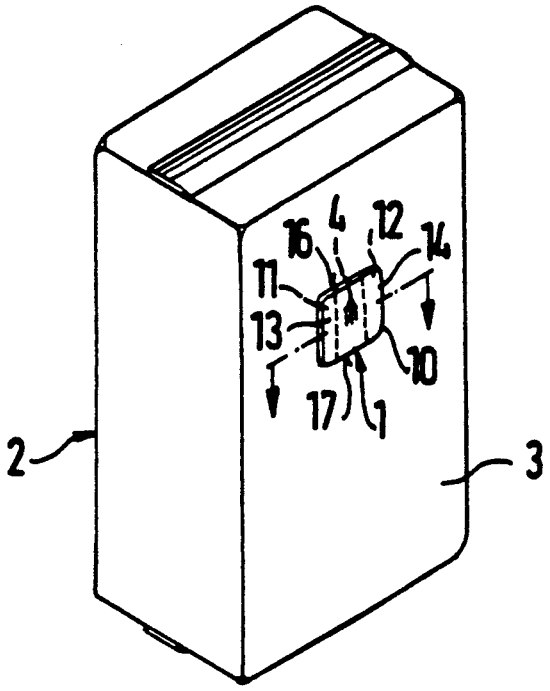
FIG. 1 shows a pouch package with an overpressure valve in a perspective view.

The overpressure valve 1 is disposed on a packaging container, for example a gas-tight pouch 2, and serves to vent gases that are produced by the packaged product. It closes off a plurality of holes 4, in the form of pin pricks, in a flat wall 3 of the pouch 2. The pouch 2 is water-vapor-proof and gas-proof and is suitable for receiving foodstuffs and luxury foods, in particular coffee, that are sensitive to air and moisture.

The overpressure valve 1 has a membrane 10 of a transparent, flexible foil. The membrane 10 comprises a foil of a thermoplastic material, such as polyester, polyethylene or the like and has a thickness of from about 20 to about 100 μm, preferably 50 μm. The starting foil may also have a barrier layer of polyvinylidene chloride.

The membrane 10 is preferably square in shape, with a length of approximately 20 mm per side and with rounded corners. The membrane 10 is secured to the wall 3 of the pouch 2 with two strips 11, 12 comprising an adhesive substance. The adhesive strips 11, 12 are shown on the inside of the membrane 10 in two parallel peripheral zones 13, 14, so that an adhesive-free center zone 15 extends between them, this zone covering the holes 4 and extending parallel to the adhesive strips 11, 12 as far as the edges 16, 17 of the membrane, at which the adhesive strips 11, 12 likewise terminate. It is also conceivable for the adhesive-free zone to end at only one edge of the membrane.

The adhesive strips 11, 12 take the form of a wedge, the pointed edge 18 of which defines the adhesive-free center zone 15 and the thick edge 19 of which is flush with the peripheral edges of the peripheral zones 13, 14 of the membrane 10. The length of the adhesive strips is about 20 mm, the width of the adhesive strips 11, 12 is 4 to 5 mm and the width of the adhesive-free zone 15 of the membrane 10 is 8 to 10 mm, for instance. On the thick outer edge 19, the adhesive strips 11, 12 have a thickness that is approximately equal to the thickness of the membrane, namely on the order of magnitude of 20 to 100 μm, preferably 50 μm. The adhesive of the strips 11, 12, which has pressure-sensitive characteristics, is preferably built up on the basis of polyurethane.

The adhesive strips 11, 12 are applied to the membrane 10, preferably before the membrane is cut out or severed from a strip of film. It may be applied in the form of a wedge-shaped string of adhesive that is ejected from a nozzle. However, strands or strings shaped in other ways may also be applied, which are then put into wedge shape by form rolling on the film.

In the closed state of the overpressure valve, in which the adhesive-free zone of the membrane 10 rests on the congruent part of the wall 3, the membrane 10 takes the form of a channel. The adhesive-free zone 15 forms a valve member, and the congruent, plane part of the wall 3 forms a valve seat. If the pressure in the interior of the pouch package rises above the ambient atmospheric pressure, the elastic, flexible adhesive-free zone 15 of the membrane 10 rises, beginning at the central region covering the holes 4, first in the form of an enlarging bubble and then in the form of a flattened bulge, in the course of which a channel forms, through which gas flows out of the interior of the pouch package. Once a certain gas quantity has been vented and with the associated reduction in the internal pressure of the package, the adhesive-free zone 15 applies itself sealingly to the wall 3 again.

Applying the adhesive in the form of a wedge has the advantage that in the region of the transition from the adhesive-free zone 15 to the peripheral zones 13, 14 to the adhesive strips 11, 12, no small channels can form that impair the tightness of the overpressure valve 1.

Also, the thick part of the adhesive strips 11, 12 acts as a spacer, so that a wall of an adjacent package in a collective package is supported on the raised peripheral zones 13, 14 of the membrane 10, so that in the presence of overpressure the adhesive-free zone 15 can bulge out freely, forming a channel, so that the overpressure valve remains functional.

Figure 5:
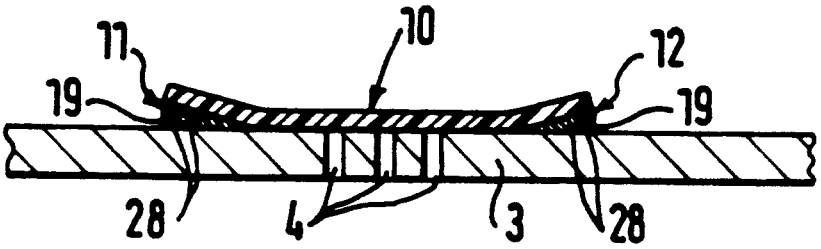
Figure 6:
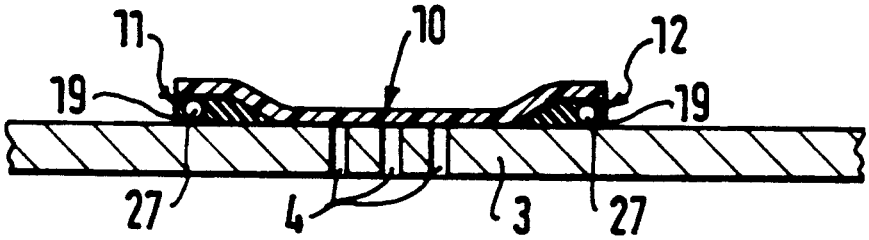

Since the plastic adhesive can flow and thereby flatten the wedge shape if pressure is exerted for a relatively long time by an adjacent package contacting it, so that raising of the adhesive-free zone 15 of the membrane 10 from the wall 3 of the pouch 2 is hindered, a further feature of the invention provides that solid bodies 28 or one continuous solid filament 27 (FIGS. 5 and 6) is embodied in the region of the thick edge 19 in the adhesive strips 11, 12. The bodies 28, which for instance comprise quartz sand, are spread onto the peripheral thick regions in a line and rolled in after the adhesive strips 11, 12 have been applied to the membrane 10. The filament 27, which comprises a plastic, can simply move along with the adhesive as the adhesive is applied. Moreover, stiff spacer strips may be disposed on the membrane 10 above the adhesive strips 11, 12.

Figure 2:
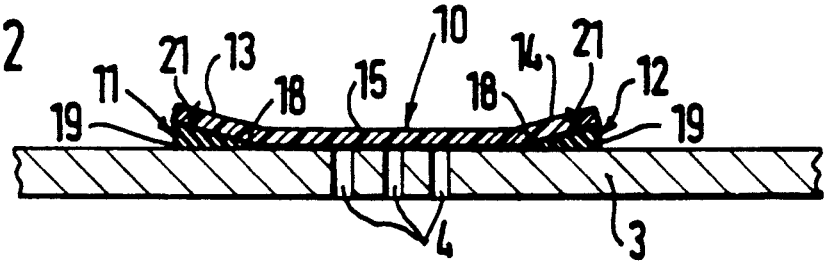
FIGS. 2 to 7 show various exemplary embodiments of the overpressure valve in cross section, on a larger scale, with the thickness (height) of the parts being shown highly exaggeratedly compared with the width.
Figure 3:
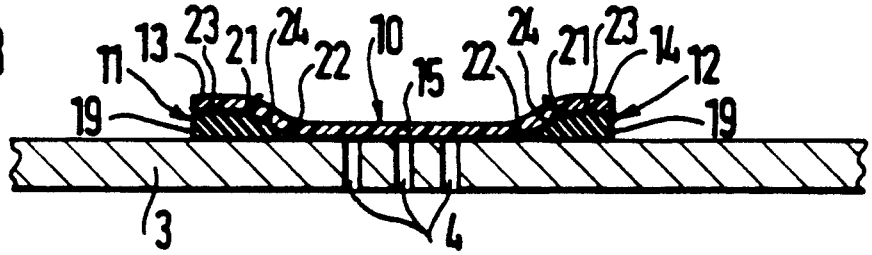
Figure 4:
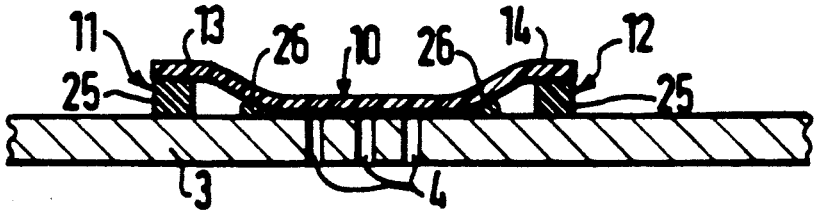

These advantages are attained if, as FIG. 2 shows, the face 21 of the strips 11, 12 resting on the membrane 10 is flat and has a uniform inclination. It is further reinforced if the face 21 is embodied in corrugated fashion (FIG. 3), so that the region 22 near the adhesive-free zone 15 and the outer region 23 have a slight inclination, while contrarily the intervening center region 24 has a great inclination. These advantages and effects can also be attained if, as FIG. 4 shows, the adhesive strips 11, 12 form a wedge lacking a cohering cross section, but instead are formed by two parallel strands 25, 26 on each of the peripheral zones 13, 14 of the membrane 10; the strands 26 of adhesive near the adhesive-free zone 15 have a very slight thickness, and the outer strands 25, near the peripheral edges, have a comparably great thickness.

To prevent diffusion of ambient air through the closed overpressure valve 1 into the interior of the package, a liquid sealant, such as silicon oil, is disposed between the adhesive-free zone 15 of the membrane 10 and the congruent part of the wall 3 of the pouch 2. As the degassing conduit forms, the film of silicon oil ruptures and then re-forms upon closure of the overpressure valve. The sealant is introduced into the channel by the deposit of a drop of it on at least one end of the channel, from where it is drawn into the channel by capillary action. Alternatively, it may be disposed on the adhesive-free zone 15 of the membrane 10 before the membrane is secured to the pouch 2. This is preferably done by disposing the sealant while the membrane 10 is still sticking to a backing strip, on which the membranes are disposed in manufacture and held in storage until they are applied to a packaging container. The sealant may be deposited on the outer ends of the adhesive-free zone, or to the central region of the adhesive-free zone if the backing strip has an aperture in the central covering region.

It is also noted that the membrane comprises a material the coefficient of thermal expansion of which is approximately equal to that of the material from which the pouch is made, so that upon temperature changes no strains arise in the membrane that affect the tightness and opening pressure of the overpressure valve.

Figure 7:
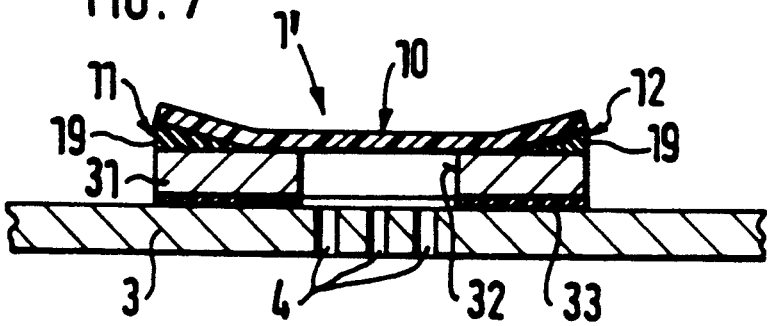

In the exemplary embodiments described above, the membrane 10 along with the wall 3 of a packaging container 2 forms an overpressure valve. If the wall 3 has little rigidity, so that uncontrollable strains are transmitted to the membrane 10, it is also possible to secure the membrane 10 with the wedge-shaped adhesive strips 11, 12 to a congruent perforated base plate 30, and to stick the thus-formed valve onto the wall of the packaging container 3 (FIG. 7). The base plate 31, which may comprise polyvinyl chloride or a similar plastic and have a thickness of 150 to 250 μm, has a central hole 32 and is provided with an adhesive film 33 over the entire surface of its underside. This kind of overpressure valve 1, is secured on the wall 3 of the pouch 2 with its hole 32 covering the holes 4 in the pouch 2.

To create a simple check by means of which it is possible to ascertain whether an overpressure valve has been disposed on a package, particles of a substance that can be scanned easily and reliably with a test device are mixed in with the adhesive of the strips 11, 12. Such substances, which may preferably have magnetic, fluorescent or luminescent properties, can operate with induction or reflected light.

The foregoing relates to a preferred exemplary embodiment of the invention it being understood that other variants and embodiments thereof are possible within the spirit and scope of the invention, the latter being defined by the appended claims.

What is claimed and desired to be secured by letters patent of the United States is:

1. An overpressure valve for packaging containers, having a membrane comprising a thin, flexible film disposed on a surface of an outer wall of the container, said membrane includes an adhesive-free center zone which overlaps at least one hole in the outer wall of the container and which is secured in place to the outer wall of the packaging container by means of oppositely disposed first and second adhesive strips which extend across a width of said membrane, said first and second adhesive strips border on the adhesive-free center zone, in a region of oppositely disposed spaced-apart peripheral zones, said membrane is secured directly onto the packaging container with the first and second adhesive strips on opposite sides of the at least one hole in the outer wall of the container, and each of the first and second adhesive strips (11, 12) are wedge shaped in cross section with a thick region along oppositely disposed edges of said membrane with a very thin region juxtaposed said adhesive-free center zone, and each of said first and second adhesive strips are secured to said packaging container with the adhesive-free center zone over said at least one hole with a wedge face of the first and second adhesive strips (11, 12) that rests on the membrane (10) being flat.

2. An overpressure valve as defined by claim 1, in which the wedge face of the first and second adhesive strips (11, 12) that rests on the membrane has first and second regions (22, 23) of slight inclination near the adhesive-free zone (15) and an outer edge of said first and second adhesive strips, respectively, and between said first and second regions a third region (24) of great inclination resides.

3. An overpressure valve as defined by claim 2, in which the first and second adhesive strips (11, 12) comprise a polyurethane-based adhesive.

4. An overpressure valve as defined by claim 2, in which first and second solid bodies (28) are embedded in the thick region of the adhesive strips (11, 12).

5. An overpressure valve as defined by claim 2, in which magnetically detectable particles are embedded in the first and second adhesive strips (11, 12).

6. An overpressure valve as set forth in claim 2, in which said overpressure valve includes a base plate (31), said base plate has a central hole (32) therethrough, said overpressure valve is secured to an upper surface of said base plate with said central section in alignment with said central hole (32) and said base plate includes an adhesive over an entire bottom surface by which said overpressure valve is secured to said packaging container.

7. An overpressure valve as defined by claim 1, in which each of the first and second adhesive strips (11, 12) are divided into first and second strands (25, 26) of great and small thickness, respectively, said small thickness is juxtaposed said adhesive-free center zone and said great thickness is along an outer end.

8. An overpressure valve as defined by claim 7, in which the first and second adhesive strips (11, 12) comprise a polyurethane-based adhesive.

9. An overpressure valve as defined by claim 7, in which first and second solid bodies (28) are embedded in the thick region of the first and second adhesive strips (11, 12).

10. An overpressure valve as defined by claim 7, in which magnetically detectable particles are embedded in the first and second adhesive strips (11, 12).

11. An overpressure valve as defined by claim 1, in which the first and second adhesive strips (11, 12) comprise a polyurethane-based adhesive.

12. An overpressure valve as defined by claim 11, in which first and second solid bodies (28) are embedded in the thick region of the first and second adhesive strips (11, 12).

13. An overpressure valve as defined by claim 1, in which first and second solid bodies (28) are embedded in the thick region of the first and second adhesive strips (11, 12).

14. An overpressure valve as defined in claim 1 in which magnetically detectable particles are embedded in the first and second adhesive strips (11, 12).

15. An overpressure valve as set forth in claim 1, in which said overpressure valve includes a base plate (31), said base plate has a central hole (32) therethrough, said overpressure valve is secured to an upper surface of said base plate with said central section in alignment with said central hole (32) and said base plate includes an adhesive over an entire bottom surface by which said overpressure valve is secured to said packaging container.

16. An overpressure valve for packaging containers, having a membrane comprising a thin, flexible film disposed on a surface of an outer wall of the container, said membrane includes an adhesive-free center zone which overlaps at least one hole in the outer wall of the container and which is secured in place to the outer wall of the packaging container by means of oppositely disposed first and second adhesive strips which extend across a width of said membrane, said first and second adhesive strips border on the adhesive-free center zone, in a region of oppositely disposed spaced-apart peripheral zones, said membrane is secured directly onto the packaging container with the first and second adhesive strips on opposite sides of the at least one hole in the outer wall of the container, and each of the first and second adhesive strips (11, 12) include a thick region along oppositely disposed edges of said membrane with a very thin region juxtaposed said adhesive-free center zone, each of which are secured to said packaging container with the adhesive-free center zone over said at least one hole, said thick region of each of said first and second adhesive strips (11, 12) include first and second solid bodies therein.

17. An overpressure valve for packaging containers, having a membrane comprising a thin, flexible film disposed on a surface of an outer wall of the container, said membrane includes an adhesive-free center zone which overlaps at least one hole in the outer wall of the container and which is secured in place to the outer wall of the packaging container by means of oppositely disposed first and second adhesive strips which extend across a width of said membrane, said first and second adhesive strips border on the adhesive-free center zone, in a region of oppositely disposed spaced-apart peripheral zones, said membrane is secured directly onto the packaging container with the first and second adhesive strips on opposite sides of the at least one hole in the outer wall of the container, and each of the first and second adhesive strips (11, 12) include a thick region along oppositely disposed edges of said membrane with a very thin region juxtaposed said adhesive-free center zone, each of which are secured to said packaging container with the adhesive-free center zone over said at least one hole, and magnetically detectable particles are embedded in each of the first and second adhesive strips (11, 12).

18. An overpressure valve for packaging containers, having a membrane comprising a thin, flexible film disposed on a surface of an outer wall of the container, said membrane includes an adhesive-free center zone which overlaps at least one hole in the outer wall of the container and which is secured in place to the outer wall of the packaging container by means of oppositely disposed first and second adhesive strips which extend across a width of said membrane, said first and second adhesive strips border on the adhesive-free center zone, in a region of oppositely disposed spaced-apart peripheral zones, said membrane is secured directly onto the packaging container with the first and second adhesive strips on opposite sides of the at least one hole in the outer wall of the container, and each of the first and second adhesive strips (11, 12) include a thick region along oppositely disposed edges of said membrane with a very thin region juxtaposed said adhesive-free center zone, each of which are secured to said packaging container with the adhesive-free center zone over said at least one hole, and optically detectable particles are embedded in each of the first and second adhesive strips (11, 12).

* * * * *